United States Patent [19]

Holtte et al.

[11] Patent Number: 4,869,401

[45] Date of Patent: Sep. 26, 1989

[54] TONER CARTRIDGE

[75] Inventors: Bruce E. Holtte, Castle Creek; John W. Trainor, Vestal, both of N.Y.

[73] Assignee: Imagitek, Binghamton, N.Y.

[21] Appl. No.: 167,032

[22] Filed: Mar. 11, 1988

[51] Int. Cl.[4] ..... B67D 5/64

[52] U.S. Cl. ..... 222/166; 222/DIG. 1

[58] Field of Search ... 222/DIG. 1, 162, 164:166–167, 222/169–170, 325, 452, 454–457, 564, 367, 362

[56] References Cited

U.S. PATENT DOCUMENTS

| | | | |
|---|---|---|---|
| 2,873,891 | 2/1959 | Pearce | 222/164 X |
| 3,618,826 | 11/1971 | Kangas | 222/166 |
| 3,722,471 | 3/1973 | Stoffel et al. | 118/637 |
| 3,847,305 | 11/1974 | Tobin | 222/166 |

*Primary Examiner*—Michael S. Huppert

*Attorney, Agent, or Firm*—Kane, Dalsimer, Sullivan, Kurucz, Levy, Eisele and Richard

[57] ABSTRACT

A cartridge dispenser for dispensing toner through the use of a plurality of baffles positioned within the cartridge which serve to collect a prescribed amount of toner and dispense it during different strokes of oscillation of the cartridge.

2 Claims, 2 Drawing Sheets

TONER CARTRIDGE

FIELD OF THE INVENTION

The present invention relates to a cartridge, particularly one for use in dispensing toner in xerographic copying machines and the like.

BACKGROUND OF THE PRESENT INVENTION

Xerographic copying machines are well known and widespread in use. A typical component in such system is a toner cartridge for containing and dispensing the toner utilized in reproduction.

A primary objective of many toner dispensing systems is to meter toner out of the cartridge and into the developer at a controlled rate; so as to match (over the long term) the rate at which toner is used by the copying process. This method of toner addition has to be adjusted to match the rate of toner depletion which is very dependent on the type of copies (the average percent coverage) being made. While this may be achievable over a long term average, there are variations in the originals and in the percent coverage that cause the toner concentration to vary to an unacceptable degree.

Sophisticated control systems have however become available and with the lower costs of sensing the actual toner concentration they provide the opportunity to close the feedback loop on a relatively short time scale. In this regard, under the conditions of closed-loop, the toner is added in response to low toner concentration, and not because some predetermined time interval has passed. Variations in the area of coverage of the originals are promptly met with the appropriate action of toner dispenser. The major time constant in the system response now becomes the total volume developer in the sump and the sensitivity of the toner concentration sensor. The control system is designed in view of these two parameters, and the total system latitude for toner concentration.

A system with active, closed-loop control, lessens the requirements often put on the toner cartridge: that of dispensing the same amount of toner throughout the life of the cartridge. The variation in toner quantity from a ne cartridge to a nearly spent cartridge has a marked effect on the quantity dispensed, particularly in gravity dispensing schemes.

With a closed-loop control, it allows such a requirement to be reduced to such an extent that the cartridge need only dispense toner evenly across the process width. Further, it does not matter what actual quantity is dispensed as long as the amount is sufficient in view of the closed loop sample time and latitude of the development system as a whole.

While some existing toner cartridges utilize active mechanisms to dispense, other toner addition schemes use gravity to cause the toner to exit the cartridge and replenish the developer. An example of toner cartridge of the latter type can be seen in U.S. Pat. No. 3,722,471 issued Mar. 27, 1973 to Stoffel. This invention discloses the use of a cartridge which is cylindrical and adapted to rotate over a developer reservoir so as to provide a metered amount of toner at a prescribed rate. A series of chutes are provided, communicating with an opening in the cartridge wall to allow for the separating an amount of toner and allowing it to be dispensed therefrom. The dispenser is meant to dispense an amount of toner into the developer reservoir in proportion to the amount of toner consumed. While such a gravity feed cartridge may be acceptable in the device envisioned therein, there exists a need for a more accurate one and one in which its operation is not adversely affected as the cartridge goes from its full to empty condition.

With the foregoing in mind, there exists a need for a copying machine toner cartridge which is relatively simple in structure and operation, but yet is effective in dispensing toner in an efficient and controlled fashion

SUMMARY OF THE INVENTION

It is therefore a principal object of the invention to provide for a cartridge for toner for use in a copying machine which takes advantage of improvements in copying machines and provides a relatively simple but effective operation.

The present invention provides a cartridge type toner supply and dispensing mechanism. The size of the cartridge is dependent on the capacity of toner to be held, and the geometry of the machine to which it is fitted. The cartridge is pivotally mounted over the developer sump to which replenishment toner is to be supplied.

This invention utilizes a simple oscillatory motion of the cartridge about its longitudinal axis. The use of additional internal rotating or sliding mechanisms are advantageously avoided in the present system. In this regard, within the cartridge is a series of fixed internal baffles which perform the functions of: (1) agitating or "fluffing" the toner to keep it from settling and compacting internal to to the cartridge; (2) collecting the toner in the vicinity of the internal exiting holes, so as to allow the cartridge to continue to dispense toner up to the total exhaustion of all the toner in the cartridge; and (3) limiting to a certain extent the toner dispensed by the cartridge by aperture size and frequency.

Furthermore, because of oscillatory motion, the cartridge can be of any shape optimal to the specific circumstances of design and is not limited by having to rotate completely around.

In addition, since there is no need for the cartridge to rotate completely around, it keeps a significant portion of the exterior of the cartridge clean and free of stray toner dust and making for a cleaner cartridge replacement when renewal is necessary.

BRIEF DESCRIPTION OF THE DRAWINGS

Thus by the present invention, its objects and advantages will be realized, the description of which should be taken in conjunction with the drawings, wherein.

DETAILED DESCRIPTION OF THE PREFERRED EMBODIMENT

Figure 1:
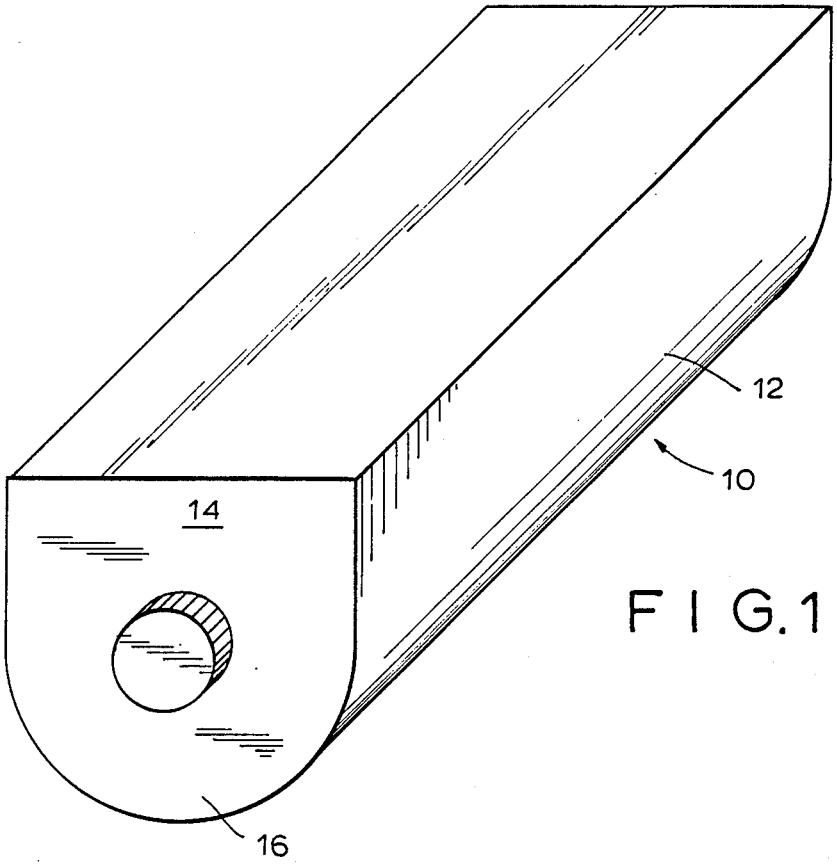
FIG. 1 is a perspective view of the toner cartridge incorporating the teachings of the present invention.

Turning now more particularly to the drawings, what is shown is a toner cartridge 10 for use in dispensing toner into a reservoir of developer in a copying machine. The cartridge body 12 is elongated and may be manufactured out of any lightweight material such as extruded or blow-molded plastic, cardboard or the like.

The size of the cartridge will depend on the particular application it is to be used in.

Because the cartridge is meant to oscillate back and forth rather than rotate, a cylindrical shape need not be utilized, rather, a squared off upper portion 14 and rounded lower portion 16 may be used instead so as to increase the volume of the toner. However, such shape, while desirable, is not critical and other shapes suitable for purpose may be used.

Since the cartridge 10 is intended to dispense toner and since it may be of the reuseable type, a filling cap 18 is provided to allow for the filling of same. This cap 18 may be of the screw-thread variety or any other type suitable for purpose. Also, the cap or other filling means may be positioned at a different location on the cartridge as long as it does not interfere with the operation of same.

The cartridge 10 is, as aforesaid, meant to oscillate back and forth, rather than rotate. The drive means for providing the oscillating motion may be any one suitable for purpose. For example, the cartridge may be mounted on a shaft coupled to a gearing arrangement and drive motor. Gears might be utilized merely on the end(s) of the cartridge. So long as the oscillating motion is provided, the means of providing it is subject to a multitude of variations.

Figure 2:
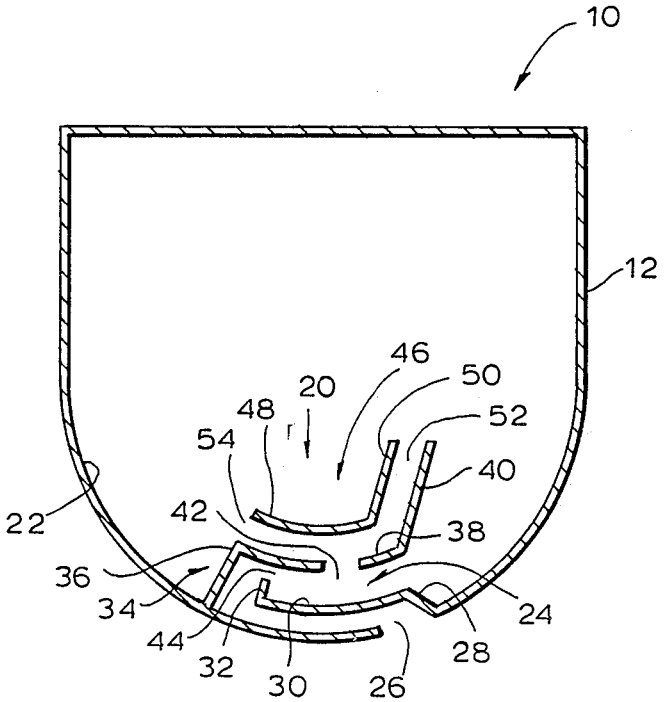
FIG. 2 is a sectional view of the toner cartridge depicting its internal baffles, incorporating the teachings of the present invention.

Referring now more particularly to FIG. 2, there is shown a cross-sectional view of the toner cartridge 10, depicting the internal labyrinthe set of stationary internal baffles 20. The baffles 20 include a plurality of members extending internally from the interior surface 22 of the cartridge. In this regard, a first baffle 24 is positioned adjacent and overhanging aperture 26 which provides an opening through the cartridge body 12. Baffle 24 includes an arm 28 coupled to surface 22 at one end and to an elongated member 30 which terminates in an upwardly extending arm 32 at its opposite end.

Positioned inwardly from baffle 24 is baffle 34 which includes an arm 36, an elongated member 38 and an upwardly extending arm 40. Note that baffle 34 includes an aperture 42 and in association with arm 32 forms aperture 44.

The last baffle 46, which is inward from baffle 34, comprises two arms 48 and 50 which are essentially parallel with member 38 and arm 40 of baffle 34. Baffles 34 and 46 form apertures 52 and 54.

The baffles serve to control the flow of toner as the cartridge body 12 oscillates back and forth about its longitudinal axis. Note that the baffles are designed so the baffle system is self-cleaning and that the system dispenses only in response to oscillatory motion; continuous rotation in either direction does not dispense toner.

While there exist different methods of fabricating these baffles , a plastic molded part is probably the easiest. The baffles can, if so desired, extend the full length of the cartridge with the openings or slots in the cartridge body small and frequent or rather large and fewer in number. In either case, both the internal baffles (20) and the openings (26) in the cartridge body would essentially be the full width of the developer sump. Note further that careful distribution of the developer can compensate to a certain extent for uneven toner usage due to the way the copy machine is used (center replenishment heavier due to center usage and/or smaller than if full width documents being copied).

Figure 3:
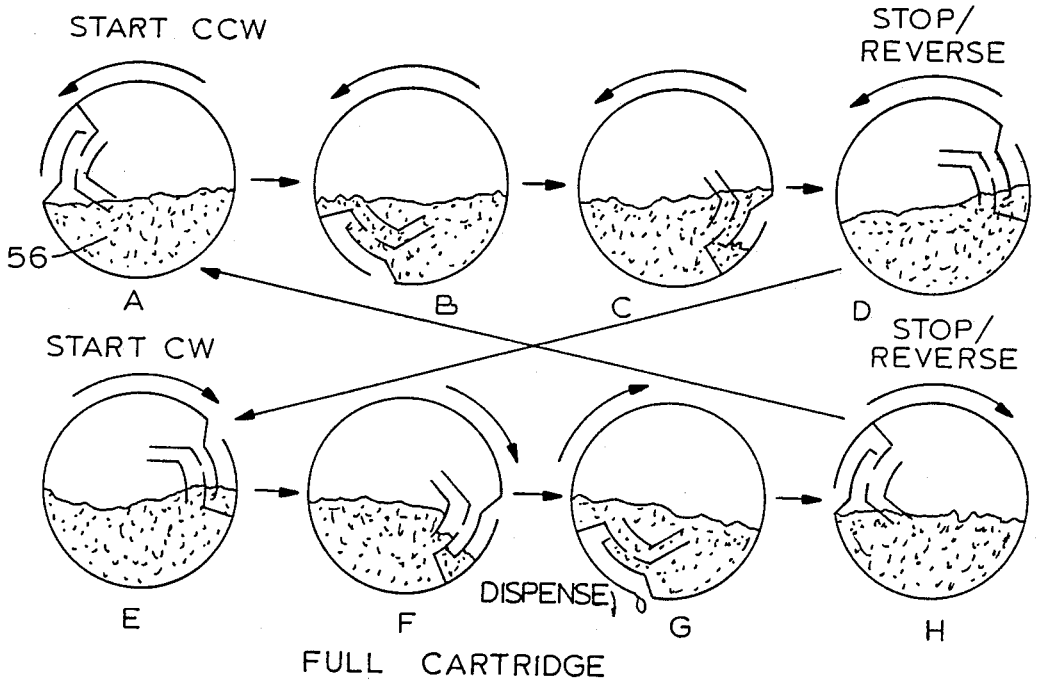
FIG. 3 is a series of operational depictions of the collecting and dispensing of toner in the situation involving a full and nearly empty cartridge, incorporating the teachings of the present invention.
Figure 3:
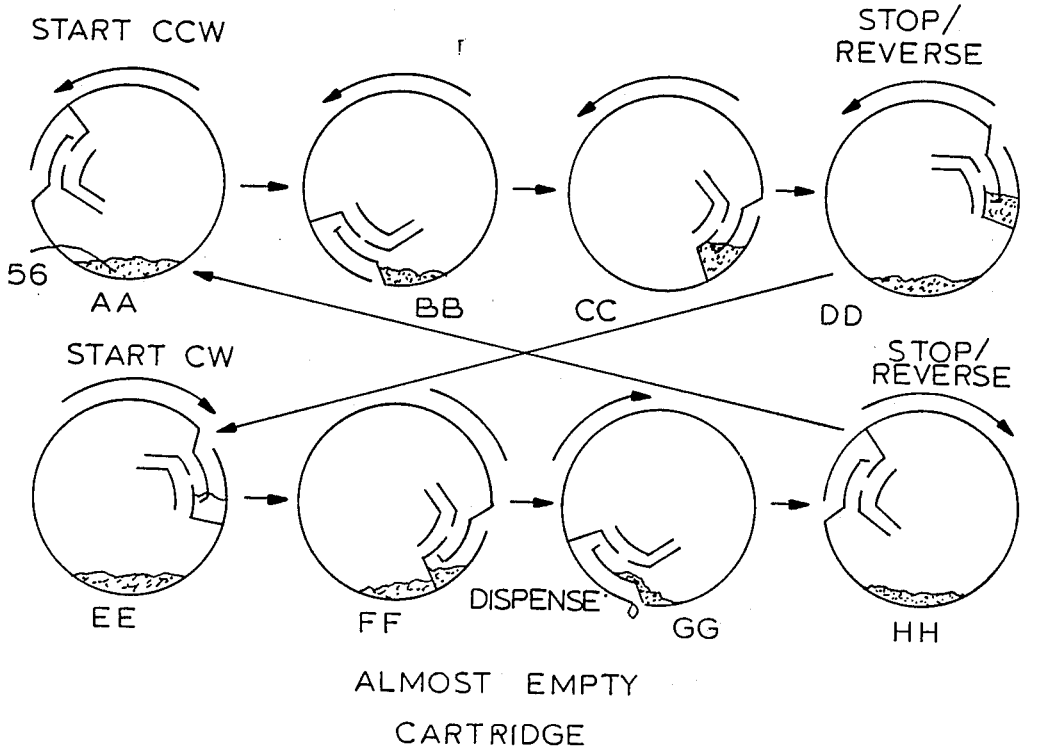

Turning now to FIG. 3, there is shown in sequence how the toner 56 is collected via the baffle 20 arrangement. In the series of drawings designated A–H, the progression of oscillation is indicated by the arrows shown. Note that for purposes of the example, the cartridge is illustrated as being circular, which it may be if so desired, but as such would avoid the advantage of extra capacity which could be provided by a different shape such as that shown in FIGS. 1 and 2.

Starting with FIG. 3A, it initially rotates counterclockwise through a first stroke such that the baffles 20 enter into and through the toner 56 present in the cartridge to a point as shown in FIG. D. At this point, a prescribed amount of toner has been captured in the baffle 20. On the return stroke (3E), this captured amount of toner is forced into the path defined by baffle 30 and surface 22 and accordingly out aperture 26 (see 3G). The cartridge continues until it returns to its original or home position (3H).

Again, the baffle arrangement is advantageously self-cleaning and dispenses only in response to oscillatory motion. Continuous rotation in either direction will not effect dispensing of toner.

Turning now to FIGS. 3AA–3HH, a semi empty cartridge is shown. As can be seen, even in an almost empty cartridge the baffled system provides for a uniform amount to be dispensed. Furthermore, due to the low angle of repose of the baffles, the toner tends to flow into the open pathways readily. In addition, as aforesaid, the internal baffles also serve to fluff the toner and keep it from setting and compacting on the internal parts which is in addition to the self-cleaning aspect thereof.

Thus by the present invention, its objects and advantages are realized and although a preferred embodiment has been disclosed and described in detail herein, its scope should not be limited thereby; rather, its scope should be determined by that of the appended claims.

What is claimed is:

1. A toner dispensing device for a photocopying machine comprising:

a container for containing toner material which is to be dispensed in a metered fashion, said container including an internal arcuate surface and subject to an oscillating cycle of a movement about its longitudinal axis;

opening means in said container for allowing the egress of toner material therefrom in predetermined amount during the oscillation of the container; and baffle means located within the container and coupled to said opening means for metering out a predetermined amount of toner during a first stroke of the container in one direction and dispensing said predetermined amount of toner through the opening means during a second stroke of the container in a direction opposite that of the first stroke, said baffle means comprises a plurality of baffles including a first baffle coupled at one end to said internal surface and disposed at a low angle of repose with respect thereto, said first baffle defining an open ended chamber coupled to the opening means; second baffle disposed adjacent and overlapping said first baffle to define a second chamber, and wherein during oscillation of the container said second chamber serves to collect said predetermined amount of toner during said first stroke which is conveyed to said first chamber during said second stroke at which time it is dispensed through the opening means and a third baffle, and a third baffle having a substantially L-shaped cross section and being positioned adjacent said second baffle for collecting said predetermined amount of toner for dispensing and wherein said second baffle includes an aperture communicating between said second chamber and a space defined between said second and third baffles.

2. The apparatus in accordance with claim 1, wherein said cartridge has a non-circular cross-section.

* * * * *